US005389281A

United States Patent [19]

Davies et al.

[11] Patent Number: 5,389,281

[45] Date of Patent: Feb. 14, 1995

[54] COMPOSITION FOR PROTECTING VINYL RECORDS

[76] Inventors: Walter E. Davies, 2811 Castro Valley Blvd., Castro Valley, Calif. 94546; Marion M. Fulk, 5116 Diane La., Livermore, Calif. 94550

[21] Appl. No.: 146,715

[22] Filed: Nov. 1, 1993

[51] Int. Cl.[6] ..... C11D 3/20; C11D 1/68; C11D 1/28; C11D 3/44

[52] U.S. Cl. ..... 252/170; 252/557; 252/DIG. 4; 252/DIG. 14; 252/DIG. 1; 252/173

[58] Field of Search ..... 252/549, 550, 551, 552, 252/553, 554, 555, 556, 557, 558, 559, 171, 172, 173, DIG. 1, DIG. 4, DIG. 14, 162, 170; 134/34, 40

[56] References Cited

U.S. PATENT DOCUMENTS

| | | | |
|---|---|---|---|
| 3,728,269 | 4/1973 | Stephenson et al. | 252/171 |
| 3,979,317 | 9/1976 | Angelini | 252/170 |
| 4,054,534 | 10/1977 | Angelini | 252/170 X |
| 4,328,279 | 5/1982 | Meitner et al. | 252/91 X |
| 4,689,168 | 8/1987 | Requejo | 252/171 X |
| 5,284,597 | 2/1994 | Rees | 252/170 X |

*Primary Examiner*—Paul Lieberman
*Assistant Examiner*—Douglas J. McGinty

[57] ABSTRACT

A composition for cleaning phonograph records and styli is disclosed which consists essentially of a lower alcohol, 3,5-dimethyl-1-hexyn-3-ol, a surfactant, and deionized water.

8 Claims, No Drawings

COMPOSITION FOR PROTECTING VINYL RECORDS

DESCRIPTION

1. Technical Field

This invention relates to the fields of materials science and physical chemistry. More particularly, the invention relates to compositions and methods for improving the wear characteristics of vinyl-based records and record-playing equipment.

2. Background of the Invention

Vinyl records continue to be one of the most accurate means for recording sound and music. Despite the durability, convenience, and availability of digital media (e.g., compact discs), many audiophiles find an audible difference between the sounds reproduced by vinyl records and CDs, and prefer the sound reproduced by records.

Vinyl records store audio information in the shape of a groove cut in each side of the record. Undulations in the groove walls cause corresponding vibrations in the stylus during playback, which are then amplified for audio enjoyment. However, the size of the contact area between stylus tip and groove is so small (about 25 $\mu^2$) that under a typical tracking force of 1 gram, the pressure on the record may be as high as 69,000 lbs per square inch. The friction between stylus and record may heat the vinyl locally to temperatures near the melting point, and may embed any particles present in the grooves. Record surfaces frequently bear dust, dirt, mold release agents, and residues from the record forming and stamping process. Under the intense pressure of playback, such surface contaminants may be plowed into the groove surface, resulting in irregularities and other damage easily audible upon replay. The stylus may also accumulate foreign matter from the record surface, and distribute such matter from record to record if not cleaned between uses.

Thus, it is important to insure that the record surface, and that of the stylus, are both free from particles of foreign matter. There is also a need for means to reduce the friction between stylus and record. However, it is critical that any cleaning composition not leave any residue after cleaning, as such residue may interfere with sound reproduction and may further contribute to friction. It is also important to avoid the use of chlorofluorocarbon solvents (e.g. Freon®), due to environmental restrictions.

Disclosure of the Invention

Compositions free of chlorofluorocarbon solvents suitable for cleaning records and styli, as well as compositions for preserving records and reducing the friction thereon, have now been invented. Cleaning compositions comprise about 1.5% to about 12.5% by volume lower alcohol, about 0.10% to about 0.91% by volume 3,5-dimethyl-1-hexyn-3-ol, about 0.005% to about 0.022% by volume suitable surfactant, and the remainder deionized water.

Compositions for preserving records comprise about 0.05% to about 0.2% by volume perfluoropolyether having an average molecular weight of about 2,000 to about 6,000, such as Fomblin® Y25, and a perfluoroalkane carrier.

Another aspect of the invention is a method for cleaning records and styli by applying thereto a composition comprising about 1.5% to about 12.5% by volume lower alcohol, about 0.10% to about 0.91% by volume 3,5-dimethyl-1-hexyn-3-ol, about 0.005% to about 0.022% by volume suitable surfactant, and the remainder deionized water.

Another aspect of the invention is a method for preserving records, comprising applying thereto a composition comprising about 0.05% to about 0.2% by volume perfluoropolyether having an average molecular weight of about 2,000 to about 6,000, such as Fomblin® Y25, and a perfluoroalkane carrier.

MODES OF CARRYING OUT THE INVENTION

A. Definitions

The term "lower alcohol" refers to alcohols having from 1–4 carbon atoms, such as methanol, ethanol, propanol, isopropanol, butanol, t-butanol, and the like.

The term "suitable surfactant" refers to compounds which are suitable surface active agents capable of stabilizing the compositions of the invention. A presently preferred suitable surfactant is Aerosol® OT-75 (sodium dioctylsulfosuccinate, Cyanamid, Wayne, N.J.).

The term "Sulfynol® 61" refers to the compound 3,5-dimethyl-1-hexyn-3-ol, obtained from Air Products, Allentown, Pa.

The term "perfluoropolyether" refers to perfluorinated polyoxyethylene-polyoxymethylene or polyoxypropylene-polyoxymethylene polymers having a molecular weight of about 2,000 g/mol to about 4,500 g/mol. Suitable perfluoropolyethers within the scope of this definition include, for example, Fomblin Y25, Fomblin Y45, Fomblin Y VAC 140/13, Fomblin Z03 (all available from Montefluos, Milan, Italy), and the like. Preferred low surface tension polymers have the formula:

$$CF_3-(O-\underset{}{\overset{CF_3}{\overset{|}{C}}}F-CF_2)_n-(O-CF_2)_m-OCF_3$$

The term "compatible fluorocarbon solvent" refers to a liquid capable of dissolving the perfluoropolyether at the desired concentrations, which is chemically inert and does not react with or soften the substrate (vinyl or other phonograph record material) to be treated. The compatible solvent will preferably have a low viscosity and a high vapor pressure, so that the solvent quickly evaporates after application. Presently preferred solvents are liquid halogenated hydrocarbons, particularly perfluorinated alkanes. Suitable compatible solvents within the scope of this definition include, without limitation, perfluorohexane, perfluoroheptane, perfluorooctane, and the like, and combinations thereof.

The term "suitable applicator" refers to a brush or swab suitable for applying the formulations of the invention. Suitable applicators will be free of lint and dust, and will not react chemically with the formulations. Suitable applicators must be soft and flexible enough to apply the formulations with causing damage to record or stylus. Suitable applicators include brushes, and lint-free clothes and pads. Preservative formulations of the invention may additionally be applied by aerosol or spray means.

B. General Methods

The present invention provides means for cleaning and protecting phonograph records without the use of chlorofluorocarbon solvents. In general, proper record care requires that one first remove dirt, dust, mold, and pressing residue from the record surface prior to playing. Suitable compositions for cleaning record and stylus comprise 3,5-dimethyl-1-hexyn-3-ol, a lower alcohol, a suitable surfactant, and water.

The concentrations of the components are adjusted for record cleaning compositions to provide maximal cleaning power, to efficiently wet the surface during cleaning, and to dry quickly without leaving a residue. Suitable concentrations for the components are about 0.10% to about 0.50% 3,5-dimethyl-1-hexyn-3-ol, about 1.5% to about 6.5% lower alcohol, about 0.005% to about 0.011% surfactant, and the remainder water. The lower alcohol is preferably ethanol, isopropanol, or a mixture thereof, most preferably isopropanol. The suitable surfactant is preferably sodium dioctylsulfosuccinate (Aerosol ® OT-75). The water is preferably highly purified, preferably triple-distilled or triple-filtered (0.2μ) deionized (18MΩ) water.

Record cleaning compositions are prepared by heating a sufficient quantity of water to about 70° C. to about 91° C., preferably about 79°–80° C. The lower alcohol is then dissolved in the warm water, and the surfactant added (typically as a 75% ethanol solution). The 3,5-dimethyl-1-hexyn-3-ol is mixed with about 100 mL of the warm water, and is then added to the aqueous alcohol/surfactant mixture. The resulting composition is then mixed to homogeneity (typically about 30–45 minutes), and allowed to cool to room temperature. The composition is preferably filtered through a 0.2 μm hydrophilic filter (e.g., as manufactured by Balston Co., Lexington, Mass., or Gelman Corp., Ann Arbor, Mich.), and then bottled in glass or plastic bottles.

Stylus cleaning compositions are generally prepared from the same components, and by the same method. However, due to the fact that the stylus is exposed to all foreign matter on the record groove surface, stronger concentrations of the cleaning components are generally called for. The component concentrations are adjusted to maximize cleaning, without leaving residue on the stylus. Thus, preferred compositions for stylus cleaning comprise about 0.45% to about 0.91% 3,5-dimethyl-1-hexyn-3-ol, about 6.0% to about 12.5% lower alcohol, about 0.011% to about 0.022% surfactant, and the remainder water. The lower alcohol is preferably ethanol, isopropanol, or a mixture thereof, most preferably isopropanol. The suitable surfactant is preferably sodium dioctylsulfosuccinate (Aerosol ® OT-75). The water is preferably highly purified, preferably triple-distilled or triple-filtered (0.2μ) deionized (18MΩ) water.

Record preservative compositions have a somewhat different function: they serve to lubricate the record surface, and protect it from friction and wear. Suitable record preservative compositions comprise a perfluoropolyether in a perfluoroalkane carrier. The perfluoropolyether is preferably a perfluoro(polyoxyethylene-polyoxymethylene) block polymer or a perfluoro(-polyoxypropylene-polyoxymethylene) block polymer, having an average molecular weight of about 3,000 g/mol. Presently preferred perfluoropolyethers include Fomblin ® Y25, Fomblin ® Z03, and the like, preferably Fomblin ® Y25/6. The carrier is generally a perfluoroalkane or mixture of perfluoroalkanes. Suitable carriers include perfluoropentane, perfluorohexane, perfluoroheptane, perfluorooctane, and the like. Presently preferred compositions contain from about 0.05% to about 0.2% Fomblin ® Y25/6, about 0.25% to about 1.0% Fluorinert ® FC40 (a perfluoroalkane), and the remainder perfluorohexane (PF5060, 3M Co.). The composition is prepared by dissolving the perfluoropolyether into Fluorinert ® FC40, and then dissolving the mixture into the perfluorohexane. The composition is filtered through a 0.2 μm filter, and is bottled in glass.

The effects of the compositions may be assayed by means of standard engineering and materials testing protocols. Compositions may most easily be tested by conducting simple comparative tests. For example, one may treat several identical records with the compositions of the invention, and leave several records untreated (or may use alternate sides of the same records as controls). The records are then played repeatedly under identical conditions for a suitable number of repetitions, e.g. 200. At the end of the test, the records are replayed, and judged for sound quality. In general, untreated records will sound "scratchy" and worn after 200 plays, with loss of high frequency sounds, and increased levels of noise. Treated records exhibit much less, if any, signs of wear. Records may also be examined under electron microscope: under such examination, treated records exhibit much less visible wear, whereas the wear for control records is easily noted.

C. Examples

The examples presented below are provided as a further guide to the practioner of ordinary skill in the art, and are not to be construed as limiting the invention in any way.

EXAMPLE 1

Cleaning Formulation for Vinyl Records

A composition suitable for cleaning vinyl phonograph records was prepared as follows:

| Component | mL |
|---|---|
| isopropanol (99%) | 62.5 |
| Surfynol ® 61 | 9.1 |
| Aerosol ® OT-75 | 0.22 |
| deionized $H_2O$ qs to | 2 L |

The water was first heated to 160° F., and the isopropanol and Aerosol OT-75 were added. The Surfynol 61 was mixed with 100 mL of heated water, and then mixed into the water/alcohol mixture, stirring 30–45 minutes until homogeneous. The formulation was then allowed to cool to room temperature.

The formulation was then filtered through a 0.2 μm hydrophilic filter (obtained from either Balston Corp., Lexington, Mass., or from Gelman Corp., Ann Arbor, Mich.), and dispensed into sterile low density polyethylene bottles.

EXAMPLE 2

Cleaning Formulation for Phonograph Stylus

A composition suitable for cleaning phonograph styli was prepared as follows:

| Component | volume % |
|---|---|
| isopropanol (99%) | 12.5 |
| Surfynol ® 61 | 0.91 |
| Aerosol ® OT-75 | 0.022 |
| deionized $H_2O$ | qs |

The water was first heated to 160° F., and the isopropanol and Aerosol OT-75 were added. The Surfynol 61 was mixed with 100 mL of heated water, and then mixed into the water/alcohol mixture, stirring 30–45 minutes until homogeneous. The formulation was then allowed to cool to room temperature.

The formulation was then filtered through a 0.2 μm hydrophilic filter (obtained from either Balston Corp., Lexington, Mass., or from Gelman Corp., Ann Arbor, Mich.), and dispensed into sterile low density polyethylene bottles.

EXAMPLE 3

Composition for Phonograph Record Preservation

A composition suitable for preserving vinyl phonograph records was prepared as follows:

Fomblin® Y25/6 (Montefluos, Milan, Italy) was mixed with Fluorinert® FC-40 (3M, St. Paul, Minn.), and the mixture dissolved in PF5060 (3M), to a final composition of Fomblin® Y25/6=0.1 v %, Fluorinert® FC-40=0.5 v %, PF5060=99.4 v %. The resulting formulation was filtered through a 0.2 μm filter, and dispensed into a glass, air-tight bottle and sealed.

What is claimed:

1. A composition for cleaning phonograph records and styli, consisting essentially of:

about 1.5% to about 12.5% by volume lower alcohol;

about 0.10% to about 0.91% by volume 3,5-dimethyl-1-hexyn-3-ol;

about 0.005% to about 0.022% by volume surfactant; and the balance being deionized water.

2. The composition of claim 1, wherein said composition consists essentially of:

about 1.5% to about 6.5% by volume lower alcohol;

about 0.10% to about 0.50% by volume 3,5-dimethyl-1-hexyn-3-ol;

about 0.005% to about 0.011% by volume surfactant; and the balance being deionized water.

3. The composition of claim 2, wherein said composition consists essentially of:

about 3.125% by volume lower alcohol;

about 0.455% by volume 3,5-dimethyl-1-hexyn-3-ol;

about 0.011% by volume surfactant; and the balance being deionized water.

4. The composition of claim 1, wherein said composition consists essentially of:

about 6.0% to about 1.2.5% by volume lower alcohol;

about 0.45% to about 0.91% by volume 3,5-dimethyl-1-hexyn-3-ol;

about 0.011% to about 0.022% by volume surfactant; and the balance being deionized water.

5. The composition of claim 4, wherein said composition consists essentially of:

about 12.5% by volume lower alcohol;

about 0.91% by volume 3,5-dimethyl-1-hexyn-3-ol;

about 0.022% by volume surfactant; and the balance being deionized water.

6. The composition of claim 1, wherein said lower alcohol comprises isopropanol.

7. The composition of claim 1, wherein said lower alcohol comprises ethanol.

8. The composition of claim 1, wherein said surfactant comprises sodium dioctylsulfosuccinate.

* * * * *